10/15/85 OR 4,546,586

United States Patent [19]

Knudson

[11] Patent Number: 4,546,586

[45] Date of Patent: Oct. 15, 1985

[54] SNAP-ON FASTENING DEVICE AND CAP ASSEMBLY FOR SEAMED PANELS

[76] Inventor: Gary A. Knudson, 17356 W. 57th Ave., Golden, Colo. 80401

[21] Appl. No.: 483,720

[22] Filed: Apr. 11, 1983

[51] Int. Cl.[4] ..... E04C 1/34

[52] U.S. Cl. ..... 52/469; 52/718.1; 52/52

[58] Field of Search ..... 52/469, 465, 459, 49, 52/52, 466, 717, 718

[56] References Cited

U.S. PATENT DOCUMENTS

| | | | |
|---|---|---|---|
| 2,428,361 | 10/1947 | Doe | 52/469 |
| 2,855,871 | 10/1958 | Huntington . | |
| 2,907,287 | 10/1959 | Trostle . | |
| 3,063,201 | 11/1962 | Rylander . | |
| 3,849,956 | 11/1974 | Collins | 52/469 X |
| 3,977,048 | 8/1975 | Benedetti | 52/718 X |
| 4,001,995 | 1/1977 | Cotter . | |
| 4,009,548 | 3/1977 | Hicks | 52/469 |

FOREIGN PATENT DOCUMENTS

| | | | |
|---|---|---|---|
| 510497 | 4/1952 | Belgium | 52/465 |
| 2144146 | 3/1973 | Fed. Rep. of Germany | 52/469 |
| 2729997 | 1/1979 | Fed. Rep. of Germany | 52/469 |
| 2070116 | 9/1981 | United Kingdom | 52/459 |

*Primary Examiner*—Donald G. Kelly
*Assistant Examiner*—Naoko N. Slack
*Attorney, Agent, or Firm*—Fields, Lewis, Pittenger & Rost

[57] ABSTRACT

Fastening devices are disclosed for firmly securing a batten cap to a standing seam connecting metal panels side by side. Each fastening device has a bight portion and a pair of opposed, spaced, resiliently yieldable legs with a slot therebetween and an entrance opening in the bottom. The legs have inside wall surface portions including opposed, inside, intermediate projections defining a skewed slot section with force-applying surface portions, as well as a top surface portion and a bottom surface portion that bear against the seam at different contact points to prevent slippage of the body on the seam. A locking surface portion bears against an overhanging surface portion of the seam to prevent the body from being pulled from the seam. The legs have oppositely disposed retaining grooves in the bottom to receive and hold the inturned flanges of a batten cap that snaps down over a plurality of said devices on the standing seam.

16 Claims, 7 Drawing Figures

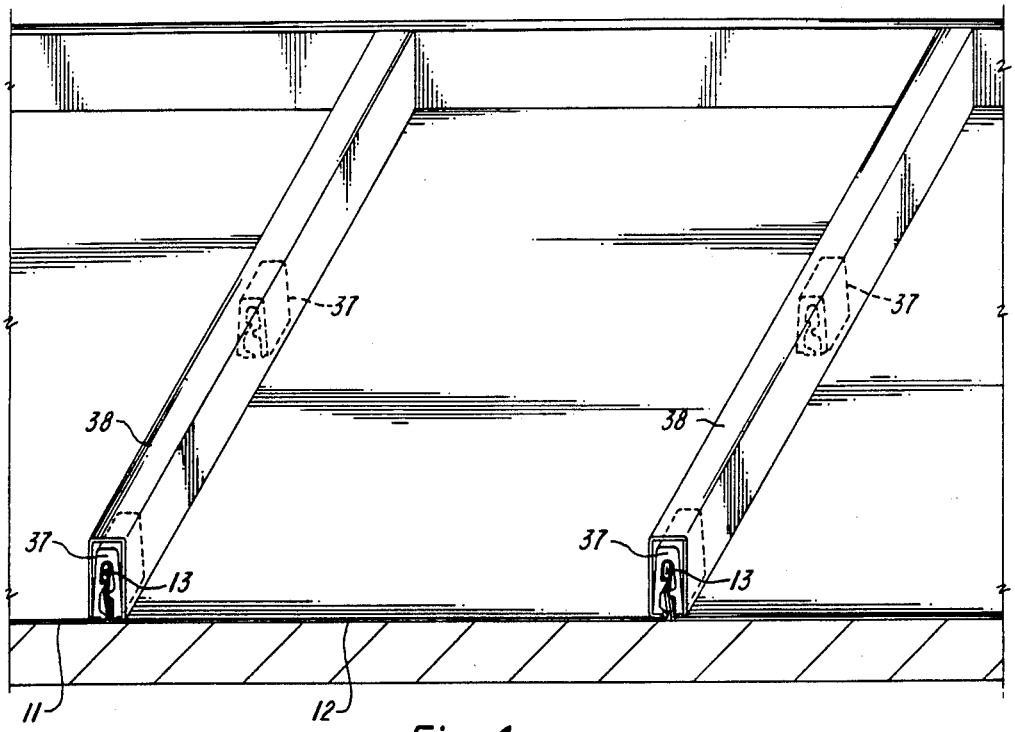
Fig_1
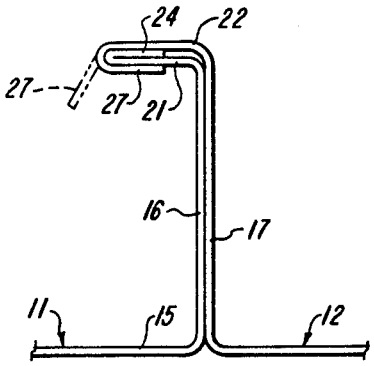
Fig_2
Fig_3
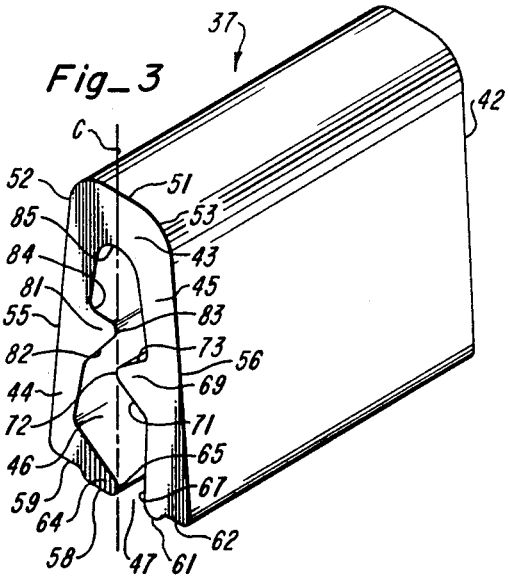

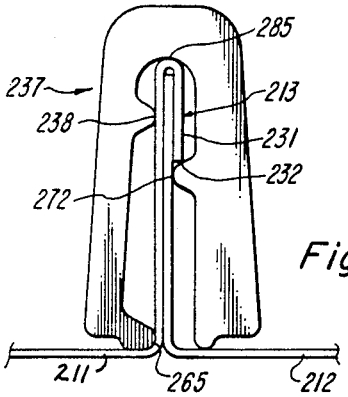
Fig_6
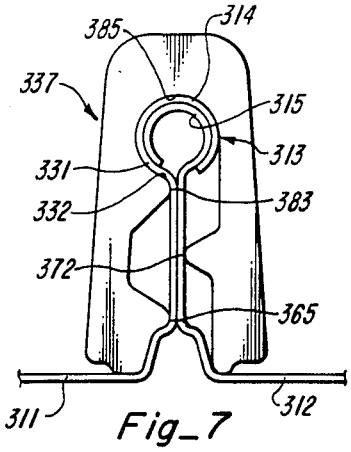
Fig_7
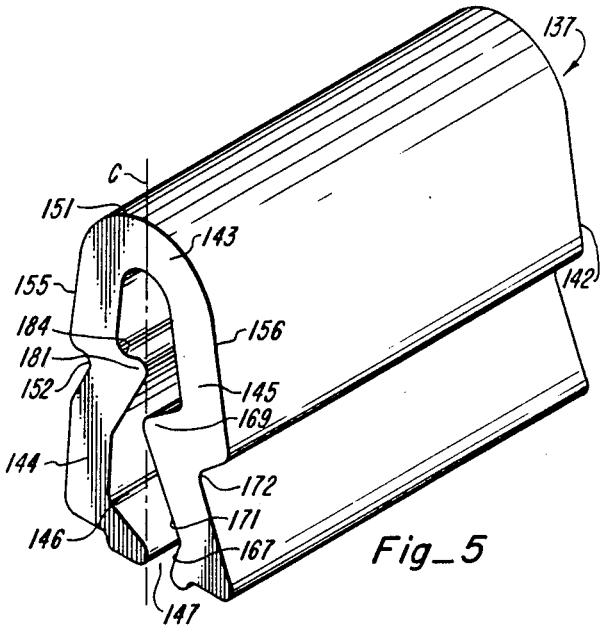
Fig_5
Fig_4
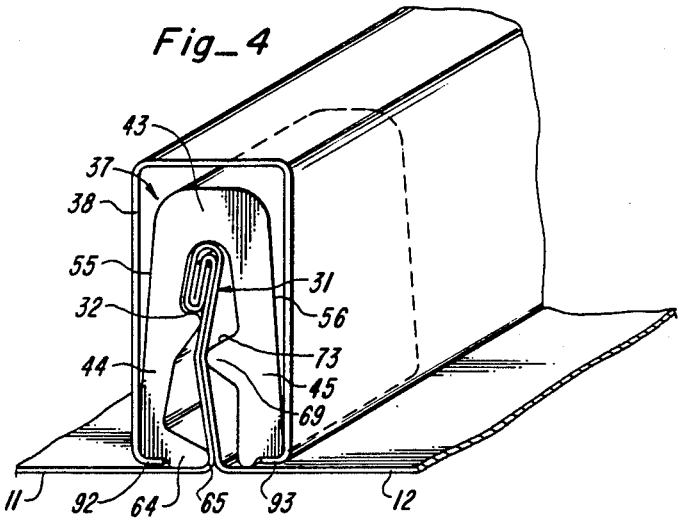

SNAP-ON FASTENING DEVICE AND CAP ASSEMBLY FOR SEAMED PANELS

TECHNICAL FIELD

This invention relates generally to improvements in covered exterior panel seams, and more particularly to a novel and improved fastening device and cap assembly for covering panel seams.

BACKGROUND ART

A number of devices have been utilized in combination with a cover or cap to fully cover a seam that connects adjacent panels. Panel connecting structures such as those disclosed in U.S. patents to Huntington No. 2,855,871, Trostle No. 2,907,287, and Rylander No. 3,063,201 have adjacent sidewalls with a space therebetween but no continuous seam is formed by the edges of the panels. Cotter U.S. Pat. No. 4,001,995 seals abutting flange edges of the panels with a sealant and then snaps a cover over the seam.

The standing seam is in common use to connect panels side by side. This seam is formed by folding the side edge flanges on the outer edges of upright sidewalls of adjacent panels in such a way as to form an integral panel assembly. The novel fastening device of the present invention is used in multiples along a standing seam or similar panel-connecting structure to firmly secure a closure strip such as a batten cap to the seam to fully cover and weatherproof the seam.

DISCLOSURE OF INVENTION

Fastening devices disclosed herein are used in multiples at spaced intervals along a seam for firmly securing a batten cap to the seam. Each fastening device has a bifurcated body with a pair of opposed resiliently yieldable legs of substantially uniform width separated by a slot with an entrance opening at the bottom. The slot is defined by opposed interior surface portions sized, shaped, and arranged in relation to exterior size and shape of the standing seam, including a skewed slot section defined by inside projections on the legs so that the forcible insertion of the body to a fully down, leg-straddling position over the seam spreads the legs so that they exert retaining forces at several points vertically of the seam to hold the device securely on the seam. An inner lock projection on one leg has a locking surface portion that bears against an overhanging surface portion of the seam in said fully down position of the body to prevent the body from being pulled from the seam. Retaining means in the form of grooves formed in the legs receive the inturned end portions of a batten cap to firmly secure the batten cap to a row of spaced apart fastening devices.

BRIEF DESCRIPTION OF DRAWINGS

The details of this invention will be described in connection with the accompanying drawings, in which:

FIG. 1 is a perspective view of a portion of a roof panel assembly including rows of fastening devices on parallel standing seams together with a batten cap on each row of fastening devices embodying features of the present invention;

FIG. 2 is an end view of two panels shown in FIG. 1, the panels having been seamed together by a first seaming operation, an unseamed flange portion being shown in dashed lines;

FIG. 3 is an enlarged perspective view of the fastening device shown in FIG. 1;

FIG. 4 is an enlarged perspective view showing the fastening device on a double-folded standing seam and a batten cap in place on the fastening device as shown in FIG. 1;

FIG. 5 is a perspective view of another form of fastening device embodying features of the present invention;

FIG. 6 is an end view of yet another form of fastening device shown mounted on a single-folded standing seam; and FIG. 7 is an end view of another form of fastening device shown mounted on a circular standing seam.

DETAILED DESCRIPTION

Referring now to the drawings, there are shown side by side panels designated 11 and 12, preferably of sheet metal, having interfitting side edge fastening portions joined at a continuous double-folded standing seam 13 to form a unitary or integral roof panel assembly. It is understood that the present invention is applicable to other types of flat panels connected by a seam, such as vertical walls. Details of the panels and the configuration of the side edge fastening portions prior to their assembly and seaming are disclosed in applicant's U.S. Pat. No. 3,967,430.

The sheet metal panels 11 and 12 are identical and each has a flat bottom wall portion 15 and a pair of upright sidewall portions 16 and 17 extending up from opposite edges of the bottom wall portion 15. Prior to assembly and final seaming, each panel has an inturned flange portion 21 that extends laterally in from the upper edge of sidewall portion 16 at right angles thereto and an outturned flange portion 22 that extends laterally outwardly from the upper edge of sidewall portion 17 at right angles thereto.

The inturned flange portion 21 has a terminal section 24 bent back over a portion of the lateral section to provide a reverse bend or fold and a double thickness of sheet metal material. The outturned flange portion 22 is initially formed as an inverted channel into which the inturned flange portion 21 of the adjacent panel will directly insert and nest. The inverted channel has a terminal section 27 which is folded back under the inturned flange portion 21 of the adjacent panel by seaming apparatus that travels along the panel flanges to connect the panels together as a unitary or integral structure and form a weathertight continuous seam.

The double-folded or double lock seam shown in FIG. 4 is formed using another seaming apparatus that folds or turns down the laterally extending flanges shown in FIG. 2 so that an upper enlarged head section 31 of the double-folded seam 13 is made up of six thicknesses of sheet metal material while the adjacent lower upstanding sidewall sections that support the head section 31 are of only two thicknesses of material. This enlarged head section 31 defines a laterally protruding overhanging surface portion 32.

The fastening device and batten cap assembly shown that is firmly secured to each seam 13 include a plurality of alined fastening devices 37 secured at spaced intervals to the seam and a cap 38, commonly referred to in the trade as a "batten cap," snapped into an assembled, fully down position fully covering the plurality of alined fastening devices 37.

Each fastening device 37 shown in FIGS. 1, 3 and 4 has a one-piece bifurcated body 42 including an upper bight portion 43 and a pair of opposed legs 44 and 45 extending downwardly from the opposite ends of said bight portion and spaced from one another by a central, upright slot 46 with an entrance opening 47 in the bottom of the body opposite the bight portion.

The upper bight portion 43 further has a flat top surface portion 51 and exterior rounded corner surface portions 52 and 53. The legs 44 and 45 have oppositely facing exterior sidewall surface portions 55 and 56, respectively, that diverge downwardly away from the bight portion and spread the batten cap as the cap is inserted thereover. Leg 44 has a bottom surface portion 58 that is formed with a bottom cap-retaining groove 59. Leg 45 has a bottom surface portion 61 that is formed with a bottom cap-retaining groove 62, so that the cap-retaining grooves are oppositely disposed from one another. The legs 44 and 45 are shown to have a substantially constant or uniform wall thickness.

Leg 44 further has a lower inwardly extending inside projection 64 that extends to approximately the vertical centerline C of the body and provides a rounded, force-applying, surface portion 65 defining one side of the entrance opening 47. Leg 45 has a straight inner surface portion 67 approximately parallel to the opposite exterior surface portion of the leg defining the opposite side of the entrance opening 47. Entrance opening 47, then, is offset to one side of the vertical centerline C of the body.

Leg 45 has a generally V-shaped intermediate projection 69 extending inwardly therefrom providing an upwardly converging inclined surface portion 71 against which the partially inserted seam will engage and slide to be directed toward te center of the slot, an inner rounded apex force-applying surface portion 72 that extends inwardly to approximately the centerline C of the body, and an upwardly diverging inclined surface portion 73.

Leg 44 has an inside intermediate projection 81 extending inwardly therefrom and offset along the slot from projection 69, projection 81 being closer to the bight portion than projection 69. Projection 81 includes an upwardly converging inclined surface portion 82, an inner rounded force-applying surface portion 83, and an upwardly facing locking surface portion 84.

The opposite inside surface portions 73 and 82 provided by projections 69 and 81, respectively, define an intermediate skewed section of the slot that is inclined at an angle to the vertical centerline C of the body through which the straight seam must pass. These offset projections will slightly deform the upright sidewalls of the panel as shown in FIG. 4.

The top or back of the slot is defined by an upper force-applying surface portion 85. The spacing between surface portion 85 and locking surface portion 84 is selected in relation to the height of the enlarged head section 31 of the seam so that surface portion 85 bears downwardly against the top surface portion 51 when the device is locked to the seam.

With this inside surface configuration defining the slot, when the body 42 is forcibly inserted over the seam 13, the top of the enlarged head section 31 will first slide along the inclined surface portion 71, then against the opposite inclined surface portion 82, and into the skewed slot section that is inclined to the centerline of the body between opposed surface portions 73 and 82. The straight configuration of the seam in the skewed slot section produces a pressure against the opposed surface portions 73 and 82 that causes the legs 44 and 45 to spread apart.

The head section 31 then slides into the upper section of the slot, which generally takes the shape of the seam head section 31, and the overhanging surface portions 32 slides over the locking surface portion 84 to snap-lock the fastening device into a locked position. In this position the surface portions 65, 72, and 85 bear against the seam at several contact points or contact areas vertically of the seam to prevent the body from sliding relative to the seam over a wide range of ambient temperatures.

Once the fastening device 37 is snap-locked in place in a fully down covering position, as shown in FIG. 4, the bottom surface portions 58 and 61 of the legs extend to the bottom of the sidewall portions 16 and 17 of the panel and are in close proximity to or bear against the horizontally disposed exterior surfaces of the bottom wall portions of the panels. Once the fastening device 37 is snap-locked in place on the seam 13, pressure is applied at the bottom of the seam by surface portion 65, at intermediate points by surface portions 72 and 83, and along the top of the seam by surface portion 85 to firmly secure device 37 to the seam.

The body 42 is made of a material that is weather resistant and has thermal stability over a wide range of hot and cold temperatures including a range of about −30° F. to about 200° F. The other characteristic required of this device is sufficient resiliency or elasticity to allow the legs to spread apart and tend to return toward the original position to apply holding forces to the panel seam. Polypropylene, polyethylene, polyvinylchloride (PVC), and nylon are examples of materials that have been found to have the necessary characteristics. These materials may be readily molded or extruded into the body configurations herein described. Body 42 is in the nature of a plastic clip and is also referred to herein as "clip-like."

The batten cap 38 is in the form of a U-shaped member preferably made of sheet metal and has inturned end flanges 92 and 93. Legs 44 and 45 of the fastening device have oppositely disposed retaining grooves 59 and 62 into which the inturned end flanges of the batten cap extend when the batten cap is inserted to a down position to hold it against forces tending to pull it upwardly from the fastening device 37.

By way of illustration, and not limitation, a typical fastening device above described and an assembly have the following dimensions:

| | |
|---|---|
| Fastening device 37: | |
| Height | 1.75 inches |
| Maximum width | .94 inch |
| Length (along seam) | 2.00 inches |
| Batten cap 38: | |
| Height | 2.00 inches |
| Width | 1.00 inch |
| Width of grooves 59, 62 | .1875 inch |
| Panels 11 and 12: | |
| Width | 8.00 to 24.00 inches |
| Height | 1.5 inches |
| Spacing between devices 37 | 12.00 to 18.00 inches |

Referring now to the modified form of fastening device 137 shown in FIG. 5, this device also has a one-piece body 142 with a bight portion 143, a pair of legs 144 and 145, a slot 146, and an entrance opening 147.

The upper bight portion has a curved top surface portion 151 with a recess 152 in the exterior wall surface 155 of leg 144. Recess 152 is opposite the inside projection 181 and is substantially the same shape as projection 181 to provide a leg 144 of substantially uniform or constant wall thickness. Leg 144 has an upwardly facing locking surface portion 184.

In turn, the intermediate inside projection 169 has a longer inclined surface portion 171 and is formed with an external recess 172 opposite projection 169 that is substantially the same shape as projection 169 to provide a leg 145 of substantially uniform or constant wall thickness. Leg 145 also has an upwardly diverging inside surface portion 167 defining one side of the entrance opening 147.

Referring now to FIG. 6, there are shown panels 211 and 212 having interfitting side edge fastening portions joined at a continous single-folded standing seam 213 including an enlarged head section 231 of three sheet metal thickness and an overhanging surface portion 232. The fastening device 237 shown for snapfastening into the single-folded seam 213 has the inside surfaces of the slot similar to device 37 above described with force-applying surface portions 265, 272, 283 and 285 bearing against the seam with a locking surface portion provided by the inside intermediate projection forming surface 272.

Referring now to FIG. 7, there are shown panels 311 and 312 having interfitting side eldge fastening portions joined at a seam 313 provided by telescoping arcuate or circular flange sections 314 and 315 formed on the side edges of the sidewall portions of the panels to form a circular enlarged head section 331 providing an overhanging surface portion 332. The fastening device 337 has inside surfaces defining a slot which include force-applying portions 365, 372 and 383 suitably positioned to contact the seam and surface portion 385 bearing against the top of the seam. The inside intermediate projections forming surface portion 383 provide a locking surface portion to prevent the body from being pulled from the seam.

The above described fastening device and cap assembly on a standing seam have been found to hold the batten cap from sliding down the seam and the tension or pressure is applied to the seam throughout a wide range of ambient temperatures up to 200° F. and down to −30° F. The fastening device is entirely weather resistant and with a batten cap porivides a weather resistant cover for the seam and a highly effective mechanical lock for the batten cap.

While the present invention has been described with a certain degree of particularity, it is understood that the present disclosure has been made by way of example and that changes in details of structure may be made without departing from the spirit thereof.

What is claimed is:

1. A fastening device for securing a cap in the form of an inverted U-shaped member with a pair of opposed inturned end flanges to the exterior of a closed seam connecting panels side by side in which an edge portion of one panel is folded over an edge portion of the other panel and forms a laterally protruding overhanging surface portion comprising:

a body having a bight portion and a pair of opposed, resiliently yieldable legs extending from opposite ends of said bight portion and spaced from one another with a slot therebetween and with an entrance opening opposite said bight portion, said legs having inside wall surface portions sized and shaped in relation to the size and shape of the seam so that, upon the forcible insertion of said body to a leg-straddling position over said seam, the legs spread apart and the resiliency of said legs applies retaining forces at several contact points vertically of said seam to firmly secure said body thereto, said body having an inside projection providing a locking surface portion facing said bight portion which will bear against the laterally protruding overhanging surface portion of the seam after said insertion to lock said body against forces tending to pull said body upwardly from the seam, said body having retaining means including opposed retainer portions under which both opposed end flanges of the cap extend, the cap being disposed in a covering position on said fastening device to hold the cap against forces tending to remove the cap from said fastening device.

2. A fastening device as set forth in claim 1 wherein said legs have oppositely facing exterior sidewall surfaces diverging away from said bight portion that spread said cap as said cap is inserted down over said body.

3. A fastening device as set forth in claim 1 wherein said legs have a substantially uniform wall thickness.

4. A fastening device as set forth in claim 1 wherein said slot includes an intermediate skewed slot section inclined at an angle to a vertical centerline of said body between the top and bottom thereof, said legs having offset force-applying inside surface portions at the top and bottom for firmly contacting the seam from opposite directions.

5. A fastening device as set forth in claim 4 wherein said skewed slot section is provided by opposed inside surface portions of a pair of oppositely disposed intermediate projections offset from one another along said slot.

6. A fastening device as set forth in claim 1 wherein one of said legs has a lower inwardly extending inside projection providing a force-applying surface portion at said entrance opening, said entrance opening being offset to one side of a vertical centerline of said body.

7. A fastening device as set forth in claim 1 wherein the spacing between a top force-applying surface portion defining the top of said slot and said locking surface portion is selected in relation to the height of said seam whereby said top force-applying surface portion bears against the top of said inserted seam to prevent said body from sliding relative to said seam.

8. A fastening device as set forth in claim 1 wherein said retaining means includes a pair of oppositely disposed grooves in the bottom of said legs into which a pair of inturned end flanges of an inverted U-shaped batten cap extend.

9. A fastening device as set forth in claim 1 wherein said panels have upright sidewall portions and said legs are of a length in relation to the height of said seam to extend to substantially the bottom of the upright sidewall portions of said panel to substantially fully cover said seam.

10. A fastening device as set forth in claim 1 wherein said body is made entirely of the same resilent plastic material.

11. A fastening device as set forth in claim 1 wherein said body has thermal stability over a wide range of hot and cold temperatures from about +30° F. to about 200° F.

12. A fastening device as set forth in claim 1 wherein said slot is shaped to receive a seam formed by telescoping arcuate flange sections on side edges of upright sidewall portions of said panels.

13. A fastening device as set forth in claim 1 wherein said panels have upright sidewall portions with side edges and said slot is shaped to receive a single-folded seam on the side edges of the upright sidewall portions of said panels.

14. A fastening device as set forth in claim 1 wherein each leg has an exterior recess substantially corresponding in shape to an oppositely disposed inside projection on the associated leg to provide a leg having substantially uniform wall thickness.

15. A snap-on clip-like fastening device for firmly securing a batten cap in the form of an inverted U-shaped member with a pair of inturned end flanges to an exterior closed standing seam connecting a pair of panels side by side, said seam having an edge portion of one panel folded over an edge portion of the other panel and including an upper enlarged head section and lower upstanding sidewall sections defining an overhanging surface, said fastening device comprising:

a resiliently yieldable, one-piece, bifurcated body made entirely of a thermally stable plastic material, said body having an upper transverse bight portion and a pair of opposed legs extending downwardly from opposite ends of said bight portion and spaced from one another by a slot with an entrance opening in the bottom thereof;

said legs having oppositely facing exterior sidewall surfaces diverging away from said bight portion that spread the batten cap as the batten cap is inserted down over said body and said legs having opposite inside wall surface portions sized and shaped in relation to the size and shape of the seam so that, upon the forcible insertion of said body over said seam, the legs spread apart and the resiliency of said legs applies inwardly directed retaining forces at several contact points vertically of said seam to prevent said body from sliding relative to said seam, said body having an inside projection providing an upwardly facing locking surface portion which will bear against said overhanging surface portion to lock said body against forces tending to pull said body upwardly from the seam, said slot including a skewed slot section inclined at an angle to the vertical centerline of said body between the top and bottom thereof and having offset force-applying inside surface portions at the top and bottom of said skewed slot sections for contacting the seam from opposite directions, said legs having oppositely disposed retaining grooves into which said pair of inturned end flanges of a batten cap extend when the batten cap is inserted to a fully down position to hold the batten cap against forces tending to pull the batten cap upwardly from said fastening device.

16. A fastening device and cap assembly secured to a seam connecting panels side by side, said seam being closed and an edge portion of one panel being folded over an edge portion of the other panel and forming a laterally protruding overhanging surface portion, said assembly comprising:

a plurality of alined, spaced apart fastening devices secured to the seam, each fastening device having a body with a bight portion and a pair of opposed, resiliently yieldable legs extending from opposite ends of said bight portions and spaced from one another with a slot therebetween and with an entrance opening opposite said bight portion, said legs having inside wall surface portions sized and shaped in relation to the size and shape of the seam to be in a leg-straddling position over said seam, the resiliency of said legs applying retaining forces at several contact points vertically of said seam to prevent slipping of said body relative to said seam, said body having an inside projection providing a locking surface portion facing said bight portion which will bear against the overhanging surface portion of the seam after insertion of said body over said seam to lock said body against forces tending to pull said body upwardly from the seam, said body having retaining means including opposed retainer portions; and a generally U-shaped inverted cap having a pair of opposed inturned end flanges extending under said opposed retainer portions to cover said plurality of alined fastening devices to hold said cap firmly to said panels.

* * * * *